US010991307B2

(12) United States Patent
Wang

(10) Patent No.: US 10,991,307 B2
(45) Date of Patent: Apr. 27, 2021

(54) PIXEL CIRCUIT AND DRIVING METHOD THEREOF, DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventor: Zheng Wang, Beijing (CN)

(73) Assignees: Beijing BOE Display Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 6 days.

(21) Appl. No.: 16/488,342

(22) PCT Filed: Jan. 14, 2019

(86) PCT No.: PCT/CN2019/071567
§ 371 (c)(1),
(2) Date: Aug. 23, 2019

(87) PCT Pub. No.: WO2019/223341
PCT Pub. Date: Nov. 28, 2019

(65) Prior Publication Data

US 2020/0402463 A1 Dec. 24, 2020

(30) Foreign Application Priority Data

May 25, 2018 (CN) ..... 201810513194.3

(51) Int. Cl.
*G09G 3/3258* (2016.01)
*G09G 3/3233* (2016.01)
*G09G 3/20* (2006.01)

(52) U.S. Cl.
CPC ..... *G09G 3/3258* (2013.01); *G09G 3/3233* (2013.01); *G09G 3/2007* (2013.01); *G09G 2310/08* (2013.01); *G09G 2330/02* (2013.01)

(58) Field of Classification Search
CPC .. G09G 3/3258; G09G 3/3233; G09G 3/2007; G09G 3/3266; G09G 3/003;
(Continued)

(56) References Cited

U.S. PATENT DOCUMENTS 6,600,472 B1 * 7/2003 Nakai ..... G09G 3/2011 345/205
7,230,597 B2 * 6/2007 Edwards ..... G09G 3/2011 345/55
(Continued)

FOREIGN PATENT DOCUMENTS

CN 1848223 A 10/2006
CN 1901008 A 1/2007
(Continued)

OTHER PUBLICATIONS

First Office Action for CN Appl. No. 201810513194.3, dated Jun. 24, 2019.

*Primary Examiner* — Christopher E Leiby
(74) *Attorney, Agent, or Firm* — The Webb Law Firm

(57) ABSTRACT

The present disclosure provides a pixel circuit and a driving method thereof, and a display device. The pixel circuit includes: a data switching circuit configured to transmit a data voltage signal received from a data line in response to an on-signal; a data storage circuit configured to store the data voltage signal and output a first voltage and a second voltage according to the data voltage signal, wherein the first voltage is lower than the second voltage; a first light emitting circuit configured to emit light when turned on by a voltage difference between the first voltage and a power supply voltage; and a second light emitting circuit configured to emit light when turned on by a voltage difference between the second voltage and the power supply voltage.

18 Claims, 8 Drawing Sheets

(58) Field of Classification Search
CPC .. G09G 3/3291; G09G 3/3225; G09G 3/3648; G09G 3/3659; G09G 3/2022; G09G 2310/08; G09G 2310/0262; G09G 2300/0814; G09G 2300/0876; G09G 2300/0861; G09G 2300/0809; G09G 2300/0852; G09G 2300/0447; G09G 2300/0443; G09G 2300/0842; G09G 2340/0435; G09G 2340/16; G09G 2320/028; G09G 2320/106; G09G 2320/0261; G09G 2320/0252; G09G 2320/10; G09G 2330/021; G09G 2330/02; H01L 27/3265; H01L 27/3262; H01L 27/12; H01L 51/5293; G02F 1/13624; G02F 1/136286; G02F 1/136213; G02F 1/1368; G02F 1/136227; G02F 2001/134345; G02F 2001/136295
See application file for complete search history.

(56) References Cited

U.S. PATENT DOCUMENTS 8,330,685 B2 * 12/2012 Park ..... G09G 3/3233 345/82
2003/0117348 A1 * 6/2003 Knapp ..... H01L 27/3211 345/76
2008/0074360 A1 * 3/2008 Lu ..... G09G 3/3233 345/77
2008/0284929 A1 * 11/2008 Kimura ..... G02F 1/13624 349/38
2011/0109612 A1 * 5/2011 Chaji ..... G09G 3/3225 345/211
2013/0249883 A1 * 9/2013 Hwang ..... G09G 3/3275 345/212
2016/0012779 A1 * 1/2016 Gu ..... G09G 3/3233 345/215
2016/0027377 A1 * 1/2016 Cho ..... H01L 27/3276 315/172
2017/0076646 A1 * 3/2017 Gu ..... G09G 3/3266
2017/0110072 A1 * 4/2017 Matsui ..... G09G 3/3607

FOREIGN PATENT DOCUMENTS

| | | | |
|---|---|---|---|
| CN | 101878502 | A | 11/2010 |
| CN | 103531149 | A | 1/2014 |
| CN | 103886834 | A | 6/2014 |
| CN | 104134426 | A | 11/2014 |
| CN | 104318894 | A | 1/2015 |
| CN | 107093401 | A | 8/2017 |
| CN | 107230455 | A | 10/2017 |
| CN | 107610653 | A | 1/2018 |
| CN | 108364607 | A | 8/2018 |
| KR | 20080102630 | A | 11/2008 |

* cited by examiner

PIXEL CIRCUIT AND DRIVING METHOD THEREOF, DISPLAY DEVICE

CROSS-REFERENCE TO RELATED APPLICATIONS

The present application is a U.S. National Stage Application under 35 U.S.C. § 371 of International Patent Application No. PCT/CN2019/071567, filed on Jan. 14, 2019, which claims priority to China Patent Application No. 201810513194.3, filed on May 25, 2018, the disclosure of both of which are incorporated by reference hereby in entirety.

TECHNICAL FIELD

The present disclosure relates to a pixel circuit, a driving method thereof, and a display device.

BACKGROUND

The OLED (Organic Light Emitting Diode) pixel structure in related art may comprise two transistors (one switching transistor and one driving transistor) and one capacitor, etc. The function of the switching transistor is to write a data signal from a data line to the capacitor. The capacitor stores the data signal for controlling a gate voltage of the driving transistor, and the driving transistor controls a current flowing through an OLED.

SUMMARY

According to an aspect of embodiments of the present disclosure, a pixel circuit is provided. The pixel circuit comprises: a data switching circuit configured to transmit a data voltage signal received from a data line in response to an on-signal from a control line; a data storage circuit configured to store the data voltage signal received from the data switching circuit and output a first voltage and a second voltage according to the data voltage signal, wherein the first voltage is lower than the second voltage; a first light emitting circuit disposed between a power supply voltage terminal and a ground terminal, and configured to emit light in a case where the first light emitting circuit is turned on by a voltage difference between the first voltage and a power supply voltage; and a second light emitting circuit disposed between the power supply voltage terminal and the ground terminal and connected in parallel with the first light emitting circuit, and configured to emit light in a case where the second light emitting circuit is turned on by a voltage difference between the second voltage and the power supply voltage.

In some embodiments, the first light emitting circuit comprises a first driving transistor and a first light emitting device, wherein a first terminal of the first driving transistor is electrically connected to the power supply voltage terminal, a second terminal of the first driving transistor is electrically connected to a first terminal of the first light emitting device, a control terminal of the first driving transistor is configured to receive the first voltage, and a second terminal of the first light emitting device is electrically connected to the ground terminal.

In some embodiments, the second light emitting circuit comprises a second driving transistor and a second light emitting device, wherein a first terminal of the second driving transistor is electrically connected to the power supply voltage terminal, a second terminal of the second driving transistor is electrically connected to a first terminal of the second light emitting device, a control terminal of the second driving transistor is configured to receive the second voltage, and a second terminal of the second light emitting device is electrically connected to the ground terminal.

In some embodiments, both of the first driving transistor and the second driving transistor are NMOS transistors; the first driving transistor is configured to make the first light emitting circuit does not emit light in a case where the data voltage signal is less than a first threshold; and the second driving transistor is configured to make the second light emitting circuit emits light in the case where the data voltage signal is less than the first threshold.

In some embodiments, the first driving transistor is further configured to make the first light emitting circuit emit light in a case where the data voltage signal is greater than or equal to the first threshold; and the second driving transistor is further configured to make the second light emitting circuit emit light in the case where the data voltage signal is greater than or equal to the first threshold.

In some embodiments, both of the first driving transistor and the second driving transistor are PMOS transistors; the first driving transistor is configured to make the first light emitting circuit does not emit light in a case where the data voltage signal is greater than a second threshold; and the second driving transistor is configured to make the second light emitting circuit emits light in the case where the data voltage signal is greater than the second threshold.

In some embodiments, the first driving transistor is further configured to make the first light emitting circuit emit light in a case where the data voltage signal is less than or equal to the second threshold; and the second driving transistor is further configured to make the second light emitting circuit emit light in the case where the data voltage signal is less than or equal to the second threshold.

In some embodiments, an area of the first light emitting device is greater than an area of the second light emitting device.

In some embodiments, the data storage circuit comprises a first capacitor and a second capacitor, wherein a first terminal of the first capacitor is electrically connected to the data switching circuit and the second light emitting circuit, a second terminal of the first capacitor is electrically connected to a first terminal of the second capacitor, the first terminal of the second capacitor is electrically connected to the first light emitting circuit, and a second terminal of the second capacitor is electrically connected to the ground terminal.

In some embodiments, the data storage circuit further comprises: a third capacitor or a diode disposed between the data switching circuit and the first capacitor.

In some embodiments, the pixel circuit further comprises an initialization circuit electrically connected to the ground terminal, and configured to raise a voltage of the first terminal of the first capacitor and a voltage of the first terminal of the second capacitor to a fixed voltage to perform an initialization process in response to an initialization signal and in a case where a voltage of the ground terminal is raised.

In some embodiments, the initialization circuit comprises: a first switching transistor, of which a first terminal is electrically connected to the first terminal of the first capacitor, a second terminal is electrically connected to the second terminal of the first capacitor, and a control terminal is configured to receive the initialization signal; and a second switching transistor, of which a first terminal is electrically connected to the first terminal of the second capacitor, a second terminal is electrically connected to the ground terminal, and a control terminal is configured to receive the initialization signal.

In some embodiments, the initialization circuit further comprises a third switching transistor, of which a first terminal is electrically connected to the data switching circuit, a second terminal is electrically connected to the first terminal of the first capacitor, and a control terminal is configured to receive the initialization signal.

In some embodiments, the first light emitting circuit further comprises a fourth switching transistor, of which a first terminal is electrically connected to the control terminal of the first driving transistor, a second terminal is electrically connected to the second terminal of the first driving transistor, and a control terminal is configured to receive a first strobe signal; the second light emitting circuit further comprises a fifth switching transistor, of which a first terminal is electrically connected to the control terminal of the second driving transistor, a second terminal is electrically connected to the second terminal of the second driving transistor, and a control terminal is configured to receive a second strobe signal; wherein the first driving transistor and the second driving transistor are configured to discharge to the power supply voltage terminal respectively, in a case where the power supply voltage is lowered, the fourth switching transistor receives the first strobe signal, and the fifth switching transistor receives the second strobe signal.

In some embodiments, the data switching circuit comprises a sixth switching transistor, of which a first terminal is electrically connected to the data line, a second terminal is electrically connected to the data storage circuit, and a control terminal is connected to the control line.

According to another aspect of embodiments of the present disclosure, a display device is provided. The display device comprises an array circuit comprising a plurality of pixel circuits as mentioned above.

According to another aspect of embodiments of the present disclosure, a driving method for a pixel circuit is provided. The pixel circuit comprises a data switching circuit, a data storage circuit, a first light emitting circuit, and a second light emitting circuit. The driving method comprises: transmitting a data voltage signal to the data storage circuit by the data switching circuit; and storing the data voltage signal, outputting a first voltage to the first light emitting circuit and outputting a second voltage to the second light emitting circuit according to the data voltage signal by the data storage circuit, such that the first light emitting circuit emits light in a case where the first light emitting circuit is turned on by a voltage difference between the first voltage and a power supply voltage, and the second light emitting circuit emits light in a case where the second light emitting circuit is turned on by a voltage difference between the second voltage and the power supply voltage, wherein the first voltage is lower than the second voltage.

In some embodiments, the pixel circuit further comprises an initialization circuit electrically connected to a ground terminal; and before the data voltage signal is transmitted to the data storage circuit, the driving method further comprises: applying an initialization signal to the initialization circuit, raising a voltage of the ground terminal, and lowering the power supply voltage.

In some embodiments, the first light emitting circuit comprises a first driving transistor, a first light emitting device, and a fourth switching transistor, a first terminal of the first driving transistor being electrically connected to a power supply voltage terminal, a second terminal of the first driving transistor being electrically connected to a first terminal of the first light emitting device, a control terminal of the first driving transistor being configured to receive the first voltage, a second terminal of the first light emitting device being electrically connected to the ground terminal, a first terminal of the fourth switching transistor being electrically connected to the control terminal of the first driving transistor, a second terminal of the fourth switching transistor being electrically connected to the second terminal of the first driving transistor, and a control terminal of the fourth switching transistor being configured to receive a first strobe signal; the second light emitting circuit comprises a second driving transistor, a second light emitting device, and a fifth switching transistor, a first terminal of the second driving transistor being electrically connected to the power supply voltage terminal, a second terminal of the second driving transistor being electrically connected to a first terminal of the second light emitting device, a control terminal of the second driving transistor being configured to receive the second voltage, a second terminal of the second light emitting device being electrically connected to the ground terminal, a first terminal of the fifth switching transistor being electrically connected to the control terminal of the second driving transistor, a second terminal of the fifth switching transistor being electrically connected to the second terminal of the second driving transistor, and a control terminal of the fifth switching transistor being configured to receive a second strobe signal; and after the initialization signal is applied to the initialization circuit and before the data voltage signal is transmitted to the data storage circuit, the driving method further comprises: in a case where the power supply voltage is lowered, applying the first strobe signal to the fourth switching transistor and applying the second strobe signal to the fifth switching transistor such that the first driving transistor and the second driving transistor discharge to the power supply voltage terminal respectively.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute part of this specification, illustrate exemplary embodiments of the present disclosure and, together with this specification, serve to explain the principles of the present disclosure.

The present disclosure will be more clearly understood from the following detailed description with reference to the accompanying drawings, in which.

Figure 1:
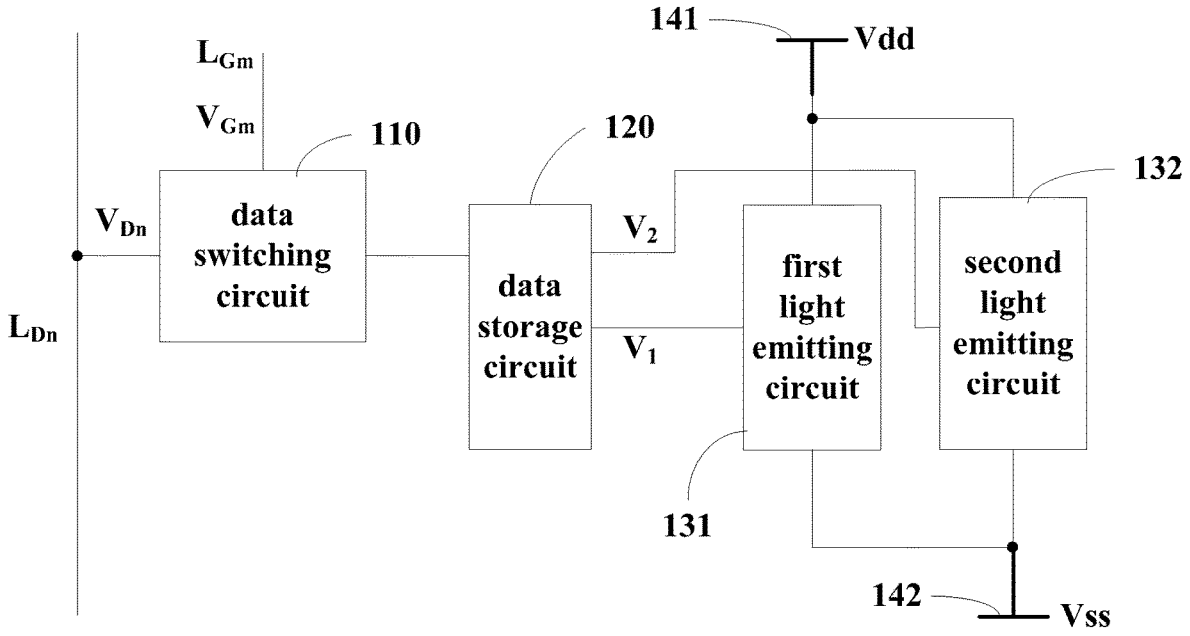
FIG. 1 is a circuit connection diagram schematically showing a pixel circuit according to an embodiment of the present disclosure.

It should be understood that the dimensions of the various parts shown in the accompanying drawings are not drawn according to the actual scale. In addition, the same or similar reference signs are used to denote the same or similar components.

DETAILED DESCRIPTION

Various exemplary embodiments of the present disclosure will now be described in detail with reference to the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "include" or variants thereof means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is electrically connected to other devices, the particular device may be directly electrically connected to said other devices without an intermediate device, and alternatively, may not be directly electrically connected to said other devices but with an intermediate device.

Unless otherwise defined, all terms (including technical and scientific terms) used herein have the same meanings as the meanings commonly understood by one of ordinary skill in the art to which the present disclosure belongs. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

The inventors of the present disclosure have found that a duty ratio of a gate voltage signal applied to a driving transistor of a pixel circuit is relatively large in the related art. For the driving transistor formed, for example, by an amorphous silicon (a-Si) process, a voltage applied to a gate of the driving transistor may cause a change in characteristics of the interface between a semiconductor layer and a gate insulating layer of the driving transistor, which results in a continuously degraded threshold voltage ($V_{th}$) of the driving transistor. For example, under the control of a gate bias voltage, the threshold voltage of the driving transistor is raised, and a current flowing through the driving transistor will be gradually attenuated. This will result in a degradation in the switching performance of the driving transistor, so that the brightness and lifetime of an OLED is affected.

Especially, in the display process of an OLED display device, the current density at a low grayscale is very small, so the current is greatly affected by a low voltage. For example, a fluctuation in voltage or a fluctuation in the device characteristics may have a large effect on the brightness at the low grayscale, resulting in an inaccurate grayscale at the low grayscale.

Therefore, in the OLED display device, since the OLED is required to be driven by a current to emit light, the current stability of the OLED is important, which directly affects grayscale accuracy. In view of this, embodiments of the present disclosure provide a pixel circuit to improve the grayscale accuracy. The structure of a pixel circuit according to some embodiments of the present disclosure will be described in detail below with reference to the accompanying drawings.

FIG. 1 is a circuit connection diagram schematically showing a pixel circuit according to an embodiment of the present disclosure.

As shown in FIG. 1, the pixel circuit comprises a data switching circuit 110, a data storage circuit 120, a first light emitting circuit 131, and a second light emitting circuit 132. Further, FIG. 1 also shows a data line $L_{Dn}$, a control line $L_{Gm}$, a power supply voltage terminal 141, and a ground terminal 142. Here, a power supply voltage $V_{dd}$ may be applied to the power supply voltage terminal 141, and a ground voltage $V_{ss}$ may be applied to the ground terminal 142.

The data switching circuit 110 is electrically connected to the data line $L_{Dn}$, the control line $L_{Gm}$, and the data storage circuit 120, respectively. The data switching circuit 110 is configured to transmit a data voltage signal $V_{Dn}$ received from the data line $L_{Dn}$ in response to an on-signal $V_{Gm}$ from the control line $L_{Gm}$. The data switching circuit 110 is turned on when it receives the on-signal $V_{Gm}$, and transmits the data voltage signal $V_{Dn}$ from the data line $L_{Dn}$ to the data storage circuit 120.

The data storage circuit 120 is electrically connected to the first light emitting circuit 131 and the second light emitting circuit 132, respectively. The data storage circuit 120 is configured to store the data voltage signal $V_{Dn}$ received from the data switching circuit 110 and output a first voltage $V_1$ and a second voltage $V_2$ according to the data voltage signal $V_{Dn}$. The first voltage $V_1$ is lower than the second voltage $V_2$. The data storage circuit 120 outputs the first voltage $V_1$ to the first light emitting circuit 131 and outputs the second voltage $V_2$ to the second light emitting circuit 132.

The first light emitting circuit 131 is disposed between the power supply voltage terminal 141 and the ground terminal 142. The first light emitting circuit 131 is configured to emit light in a case where the first light emitting circuit 131 is turned on by a voltage difference between the first voltage $V_1$ and the power supply voltage $V_{dd}$.

The second light emitting circuit 132 is disposed between the power supply voltage terminal 141 and the ground terminal 142. The second light emitting circuit 132 is connected in parallel with the first light emitting circuit 131. The second light emitting circuit 132 is configured to emit light in a case where the second light emitting circuit 132 is turned on by a voltage difference between the second voltage $V_2$ and the power supply voltage $V_{dd}$.

In the above embodiments, a pixel circuit is provided. In the pixel circuit, a first light emitting circuit and a second light emitting circuit are provided. These two light emitting circuits together serve as a light emitting circuit of a pixel structure. After receiving a data voltage signal, a data storage circuit stores the data voltage signal, outputs a first voltage to the first light emitting circuit and outputs a second voltage to the second light emitting circuit according to the data voltage signal. Since the first voltage is lower than the second voltage, the second light emitting circuit is more likely to emit light than the first light emitting circuit. Thus, in a case where a grayscale corresponding to the data voltage signal is a low grayscale, the second light emitting circuit is enabled to emit light while the first light emitting circuit does not emit light. The brightness of the light emitted by the second light emitting circuit can be regarded as the brightness of an entire pixel. In a case where a driving current of the second light emitting circuit is relatively large, the brightness of the second light emitting device is relatively strong, but is still weak from the perspective of the entire pixel. Since the driving current of the second light emitting circuit may be relatively large, the luminance grayscale accuracy of the pixel circuit may be improved in low grayscale situations.

In some embodiments, high grayscales and low grayscales may be set according to actual needs. For example, a grayscale value greater than or equal to a grayscale threshold may be referred to as a high grayscale, and a grayscale value less than the grayscale threshold may be referred to as a low grayscale. For example, the grayscale threshold may be a 16th gray scale or a 32nd gray scale, etc. Of course, those skilled in the art should understand that the grayscale threshold may be determined according to actual situations. For example, different manufacturing processes may result in different grayscale thresholds. Moreover, the scope of embodiments of the present disclosure is not limited to the grayscale thresholds disclosed herein. For example, the grayscale threshold may also be a 40th gray scale or a 50th gray scale, etc.

In the case of a low grayscale, the first light emitting circuit does not emit light and the second light emitting circuit emits light, and the light emitted by the second light emitting circuit can reach a desired grayscale value of the entire pixel. In the case of a high grayscale, both light emitting circuits emit light to reach a desired grayscale value of the entire pixel. In this way, the grayscale accuracy in low grayscale situations may be improved and the brightness in high grayscale situations is ensured as much as possible.

It should be noted that, in some cases, for the same grayscale value, a corresponding data voltage signal in embodiments of the present disclosure may not be equal to a corresponding data voltage signal in the related art. Therefore, in order to reach a grayscale value corresponding to the data voltage signal in the related art, the data voltage signal of embodiments of the present disclosure may be adjusted until the data voltage signal causes the brightness of the light emitted by the light emitting circuit to reach the grayscale value. Of course, those skilled in the art should understand that, in other cases, for the same grayscale value, the corresponding data voltage signal in embodiments of the present disclosure may be equal to the corresponding data voltage signal in the related art.

Figure 2:
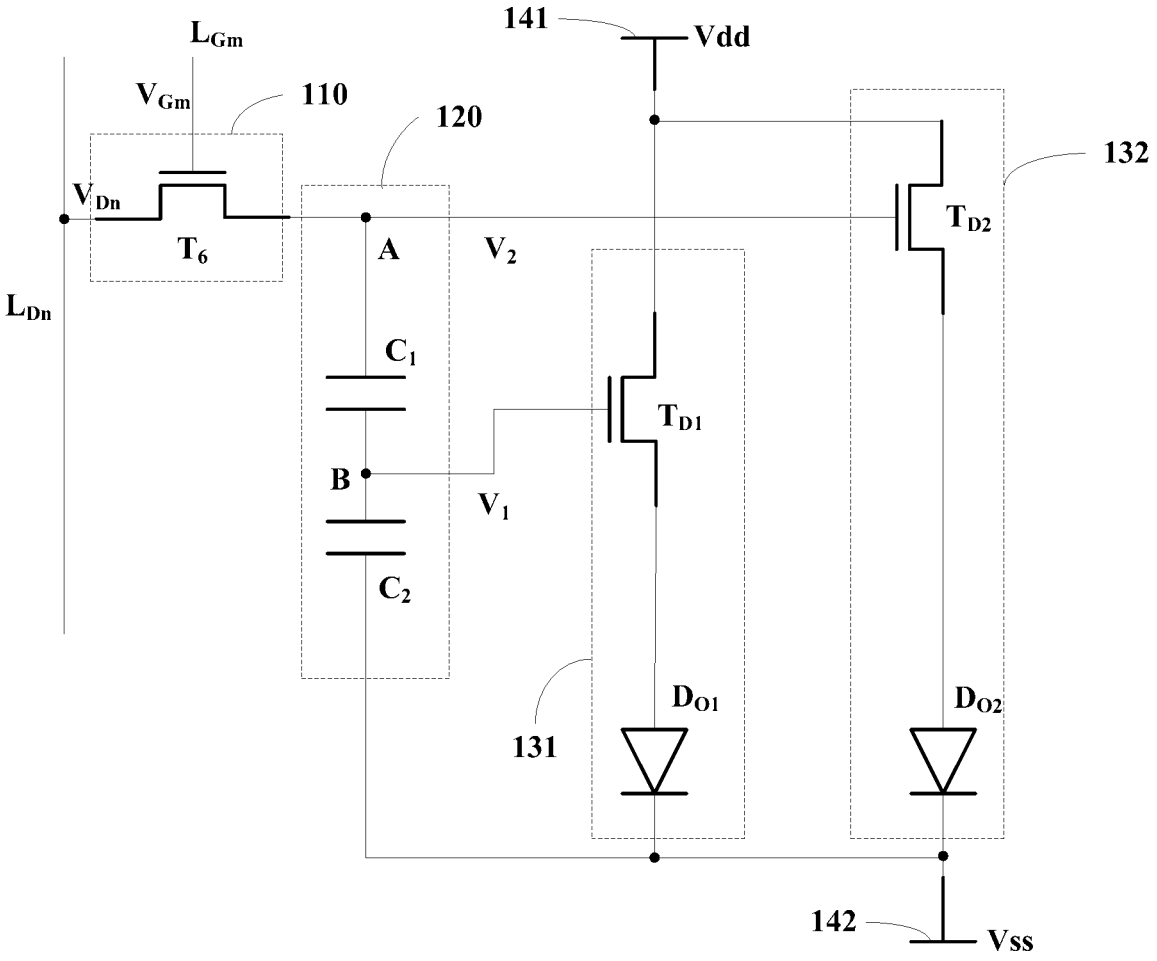
FIG. 2 is a circuit connection diagram schematically showing a pixel circuit according to another embodiment of the present disclosure.

FIG. 2 is a circuit connection diagram schematically showing a pixel circuit according to another embodiment of the present disclosure.

In some embodiments, as shown in FIG. 2, the first light emitting circuit 131 may comprise a first driving transistor $T_{D1}$ and a first light emitting device $D_{O1}$. For example, the first light emitting device may comprise an OLED device, etc. As shown in FIG. 2, a first terminal of the first driving transistor $T_{D1}$ is electrically connected to the power supply voltage terminal 141. A control terminal (for example, a gate) of the first driving transistor $T_{D1}$ may be configured to receive the first voltage $V_1$. A first terminal (for example, an anode terminal) of the first light emitting device $D_{O1}$ is electrically connected to a second terminal of the first driving transistor $T_{D1}$. A second terminal (for example, a cathode terminal) of the first light emitting device $D_{O1}$ is electrically connected to the ground terminal 142.

In some embodiments, as shown in FIG. 2, the first driving transistor $T_{D1}$ may be an NMOS (N-channel Metal Oxide Semiconductor) transistor. Thus, in a case where the voltage difference between the first voltage $V_1$ and the power supply voltage $V_{dd}$ is greater than or equal to a threshold voltage of the first driving transistor $T_{D1}$, the first driving transistor $T_{D1}$ is turned on so that the first light emitting device $D_{O1}$ emits light. On the contrary, in a case where the voltage difference between the first voltage $V_1$ and the power supply voltage $V_{dd}$ is less than the threshold voltage of the first driving transistor $T_{D1}$, the first driving transistor $T_{D1}$ is turned off so that the first light emitting device $D_{O1}$ does not emit light.

In other embodiments, the first driving transistor $T_{D1}$ may be a PMOS (P-channel Metal Oxide Semiconductor) transistor. Thus, in a case where the voltage difference between the first voltage $V_1$ and the power supply voltage $V_{dd}$ is less than or equal to the threshold voltage of the first driving transistor $T_{D1}$, the first driving transistor $T_{D1}$ is turned on so that the first light emitting device $D_{O1}$ emits light. On the contrary, in a case where the voltage difference between the first voltage $V_1$ and the power supply voltage $V_{dd}$ is greater than the threshold voltage of the first driving transistor $T_{D1}$, the first driving transistor $T_{D1}$ is turned off so that the first light emitting device $D_{O1}$ does not emit light.

In some embodiments, as shown in FIG. 2, the second light emitting circuit 132 may comprise a second driving transistor $T_{D2}$ and a second light emitting device $D_{O2}$. For example, the second light emitting device may comprise an OLED device, etc. As shown in FIG. 2, a first terminal of the second driving transistor $T_{D2}$ is electrically connected to the power supply voltage terminal 141. A control terminal (for example, a gate) of the second driving transistor $T_{D2}$ may be configured to receive the second voltage $V_2$. A first terminal (for example, an anode terminal) of the second light emitting device $D_{O2}$ is electrically connected to a second terminal of the second driving transistor $T_{D2}$. A second terminal (for example, a cathode terminal) of the second light emitting device $D_{O2}$ is electrically connected to the ground terminal 142.

In some embodiments, as shown in FIG. 2, the second driving transistor $T_{D2}$ may be an NMOS transistor. Thus, in a case where the voltage difference between the second voltage $V_2$ and the power supply voltage $V_{dd}$ is greater than or equal to a threshold voltage of the second driving transistor $T_{D2}$, the second driving transistor $T_{D2}$ is turned on so that the second light emitting device $D_{O2}$ emits light. On the contrary, in a case where the voltage difference between the second voltage $V_2$ and the power supply voltage $V_{dd}$ is less than the threshold voltage of the second driving transistor $T_{D2}$, the second driving transistor $T_{D2}$ is turned off so that the second light emitting device $D_{O2}$ does not emit light.

In other embodiments, the second driving transistor $T_{D2}$ may be a PMOS transistor. Thus, in a case where the voltage difference between the second voltage $V_2$ and the power supply voltage $V_{dd}$ is less than or equal to the threshold voltage of the second driving transistor $T_{D2}$, the second driving transistor $T_{D2}$ is turned on so that the second light emitting device $D_{O2}$ emits light. On the contrary, in the case where the voltage difference between the second voltage $V_2$ and the power supply voltage $V_{dd}$ is greater than the threshold voltage of the second driving transistor $T_{D2}$, the second driving transistor $T_{D2}$ is turned off so that the second light emitting device $D_{O2}$ does not emit light.

In some embodiments, both of the first driving transistor $T_{D1}$ and the second driving transistor $T_{D2}$ may be NMOS transistors. In a case where the data voltage signal $V_{Dn}$ is less than a first threshold (for example, the first threshold is a positive voltage value), the first light emitting circuit 131 does not emit light, and the second light emitting circuit 132 emits light. That is, the first driving transistor is configured to make the first light emitting circuit does not emit light in the case where the data voltage signal is less than the first threshold; and the second driving transistor is configured to make the second light emitting circuit emits light in the case where the data voltage signal is less than the first threshold. It should be noted that although the data voltage signal is less than the first threshold, the data voltage signal has a voltage value that enables the second drive transistor to be turned on. In a case where the data voltage signal $V_{Dn}$ is greater than or equal to the first threshold, the first light emitting circuit 131 and the second light emitting circuit 132 both emit light. That is, the first driving transistor is further configured to make the first light emitting circuit emit light in a case where the data voltage signal is greater than or equal to the first threshold; and the second driving transistor is further configured to make the second light emitting circuit emit light in the case where the data voltage signal is greater than or equal to the first threshold. In this embodiment, both driving transistors are NMOS transistors, a data voltage signal less than the first threshold corresponds to a case where the grayscale of the light emitted by the pixel circuit is a low grayscale, and a data voltage signal greater than or equal to the first threshold corresponds to a case where the grayscale of the light emitted by the pixel circuit is a high grayscale. The first threshold may be determined according to an actual situation.

In other embodiments, both of the first driving transistor $T_{D1}$ and the second driving transistor $T_{D2}$ may be PMOS transistors. In the case where the data voltage signal $V_{Dn}$ is greater than a second threshold (for example, the second threshold is a negative voltage value), the first light emitting circuit 131 does not emit light, and the second light emitting circuit 132 emits light. That is, the first driving transistor is configured to make the first light emitting circuit does not emit light in a case where the data voltage signal is greater than the second threshold; and the second driving transistor is configured to make the second light emitting circuit emits light in the case where the data voltage signal is greater than the second threshold. It should be noted that although the data voltage signal is greater than the second threshold, the data voltage signal has a voltage value that enables the second drive transistor to be turned on. In a case where the data voltage signal $V_{Dn}$ is less than or equal to the second threshold, the first light emitting circuit 131 and the second light emitting circuit 132 both emit light. That is, the first driving transistor is further configured to make the first light emitting circuit emit light in the case where the data voltage signal is less than or equal to the second threshold; and the second driving transistor is further configured to make the second light emitting circuit emit light in the case where the data voltage signal is less than or equal to the second threshold. In this embodiment, both driving transistors are PMOS transistors, a data voltage signal greater than the second threshold corresponds to a case where the grayscale of the light emitted by the pixel circuit is a low grayscale, and a data voltage signal less than or equal to the second threshold corresponds to a case where the grayscale of the light emitted by the pixel circuit is a high grayscale. The second threshold may be determined according to an actual situation.

In some embodiments, an area of the first light emitting device $D_{O1}$ is larger than an area of the second light emitting device $D_{O2}$. The first light emitting device and the second light emitting device serve as two light emitting devices within one pixel structure. In the case of a low grayscale, the second light emitting device emits light and the first light emitting device does not emit light. Since the area of the first light emitting device is larger than the area of the second light emitting device, the relatively strong light emitted by the second light emitting device having a smaller area can be used as the light emitted by the entire pixel, which overall is relatively weak and thereby corresponds to a brightness at a low grayscale. Furthermore, in the case of a high grayscale, both light emitting devices emit light. However, since the first voltage is lower than the second voltage, a driving current of the second light emitting circuit may be greater than a driving current of the first light emitting circuit. Accordingly, the brightness of the second light emitting device may be higher than the brightness of the first light emitting device. However, since the area of the second light emitting device with higher brightness is relatively small, the area of the first light emitting device with lower brightness is relatively large, from the perspective of a complete pixel, the overall brightness still satisfies the corresponding grayscale value.

Certainly, those skilled in the art should understand that the scope of the embodiments of the present disclosure is not limited to the area relationship of the two light emitting devices described above. For example, the area of the first light emitting device may also be less than or equal to the area of the second light emitting device.

In some embodiments, as shown in FIG. 2, the data storage circuit 120 may comprise a first capacitor $C_1$ and a second capacitor $C_2$. A first terminal of the first capacitor $C_1$ is electrically connected to the data switching circuit 110 and the second light emitting circuit 132. For example, the first terminal of the first capacitor $C_1$ is electrically connected to the control terminal of the second driving transistor $T_{D2}$. A second terminal of the first capacitor $C_1$ is electrically connected to a first terminal of the second capacitor $C_2$. The first terminal of the second capacitor $C_2$ is electrically connected to the first light emitting circuit 131. For example, the first terminal of the second capacitor $C_2$ is electrically connected to the control terminal of the first driving transistor $T_{D1}$. A second terminal of the second capacitor $C_2$ is electrically connected to the ground terminal 142.

As shown in FIG. 2, the first terminal of the first capacitor $C_1$, the data switching circuit 110, and the control terminal of the second drive transistor $T_{D2}$ are electrically connected to a first node A. The second terminal of the first capacitor $C_1$, the first terminal of the second capacitor $C_2$, and the control terminal of the first driving transistor $T_{D1}$ are electrically connected to a second node B. In a case where the data switching circuit 110 transmits the data voltage signal $V_{Dn}$ received from the data line, a potential at the first node A is $V_A=V_2=V_{Dn}$, a potential at the second node B is $V_B=V_1$, and $$Q_1=Q_2, \tag{1}$$

$$Q_1=C_1(V_A-V_B) \tag{2}$$

$$Q_2=C_2(V_B-0) \tag{3}$$

wherein $Q_1$ is the charge on the first capacitor and $Q_2$ is the charge on the second capacitor. Further, in addition to the first capacitor and the second capacitor in the circuit, $C_1$ and $C_2$ can also represent the capacitance values of the first capacitor and the second capacitor in the above formulas, respectively.

From the above formulas (1) to (3), the potential $V_A$ of the first node A, and the potential $V_B$ of the second node B, it can be obtained:

$$V_1 = \frac{V_{Dn}}{1+\frac{C_2}{C_1}}.$$

Therefore, the first voltage $V_1$ and the second voltage $V_2$ in the embodiment shown in FIG. 2 are obtained by the calculation process described above. The first voltage $V_1$ is output to the first light emitting circuit 131 to control the light emission of the first light emitting device, and the second voltage $V_2$ is output to the second light emitting circuit 132 to control the light emission of the second light emitting device. In some embodiments of the present disclosure, the desired first voltage $V_1$ may be obtained by designing the capacitance values of the first capacitor $C_1$ and the second capacitor $C_2$.

In some embodiments, as shown in FIG. 2, the data switching circuit 110 may comprise a sixth switching transistor T6. A first terminal of the sixth switching transistor T6 is electrically connected to the data line $L_{Dn}$. A second terminal of the sixth switching transistor T6 is electrically connected to the data storage circuit 120. For example, the second terminal of the sixth switching transistor T6 is electrically connected to the first terminal of the first capacitor $C_1$. A control terminal (for example, a gate) of the sixth switching transistor T6 is electrically connected to the control line $L_{Gm}$. The sixth switching transistor T6 is turned on when its control terminal receives the on-signal $V_{Gm}$ from the control line $L_{Gm}$, so that the data voltage signal $V_{Dn}$ received from the data line $L_{Dn}$ may be transmitted to the data storage circuit 120, for example, to the first terminal of the first capacitor $C_1$.

Figure 3:
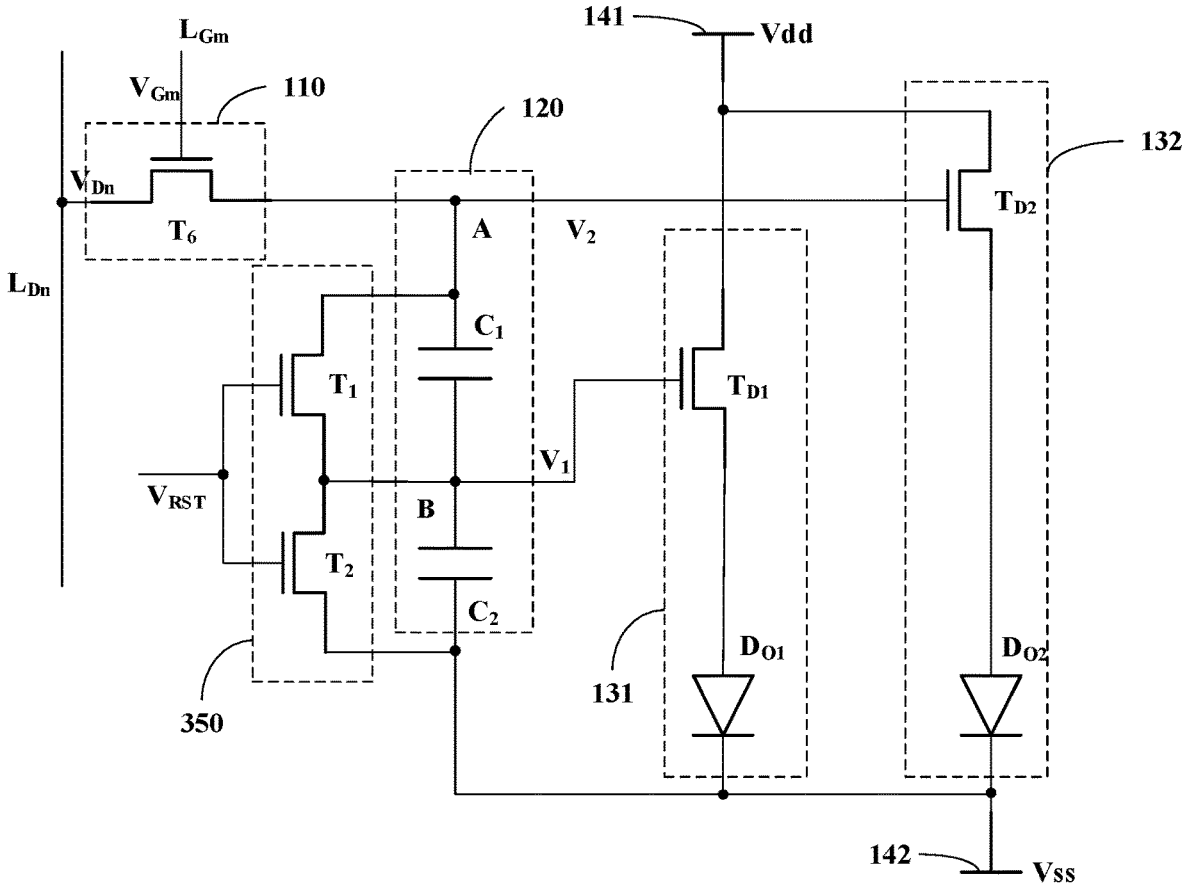
FIG. 3 is a circuit connection diagram schematically showing a pixel circuit according to another embodiment of the present disclosure.

FIG. 3 is a circuit connection diagram schematically showing a pixel circuit according to another embodiment of the present disclosure. On the basis of the pixel circuit shown in FIG. 2, an initialization circuit 350 is added in the pixel circuit shown in FIG. 3.

In some embodiments, as shown in FIG. 3, the pixel circuit may also comprise the initialization circuit 350. The initialization circuit 350 is electrically connected to the ground terminal 142. the initialization circuit 350 is configured to raise a voltage of the first terminal of the first capacitor $C_1$ (i.e., the voltage of the first node A) and a voltage of the first terminal of the second capacitor $C_2$ (i.e., the voltage of the second node B) to a fixed voltage to perform an initialization process in response to an initialization signal $V_{RST}$ and in a case where a voltage of the ground terminal is raised. In this embodiment, the initialization process of the initialization circuit may cause the voltage of the first terminal of the first capacitor and the voltage of the first terminal of the second capacitor to reach a fixed voltage to remove a previous frame data signal (for example, the second voltage or the first voltage) that may be stored on the first capacitor and the second capacitor, which is advantageous for improving the luminance grayscale accuracy of the pixel circuit.

In some embodiments, as shown in FIG. 3, the initialization circuit 350 may comprise a first switching transistor $T_1$. A first terminal of the first switching transistor $T_1$ is electrically connected to the first terminal of the first capacitor $C_1$. For example, the first terminal of the first switching transistor $T_1$ is electrically connected to the first node A. A second terminal of the first switching transistor $T_1$ is electrically connected to the second terminal of the first capacitor $C_1$ (for example, the second terminal of the first switching transistor $T_1$ is electrically connected to the second node B). A control terminal (for example, a gate) of the first switching transistor $T_1$ may be configured to receive the initialization signal $V_{RST}$.

In some embodiments, as shown in FIG. 3, the initialization circuit may further comprise a second switching transistor $T_2$. A first terminal of the second switching transistor $T_2$ is electrically connected to the first terminal of the second capacitor $C_2$ (for example, the first terminal of the second switching transistor $T_2$ is electrically connected to the second node B). A second terminal of the second switching transistor $T_2$ is electrically connected to the ground terminal 142. A control terminal (for example, a gate) of the second switching transistor $T_2$ may be configured to receive the initialization signal $V_{RST}$.

In the above embodiment, the first switching transistor $T_1$ and the second switching transistor $T_2$ are turned on respectively when they receive the initialization signal $V_{RST}$, and the voltage $V_{ss}$ of the ground terminal is raised. This may initiate the voltage of the first terminal of the first capacitor $C_1$ (i.e., the first node A) and the voltage of the first terminal of the second capacitor $C_2$ (i.e., the second node B) to a fixed voltage, so that a previous frame data signal that may be stored on the first capacitor and the second capacitor is removed, which is advantageous for improving the luminance grayscale accuracy of the pixel circuit.

Figure 4:
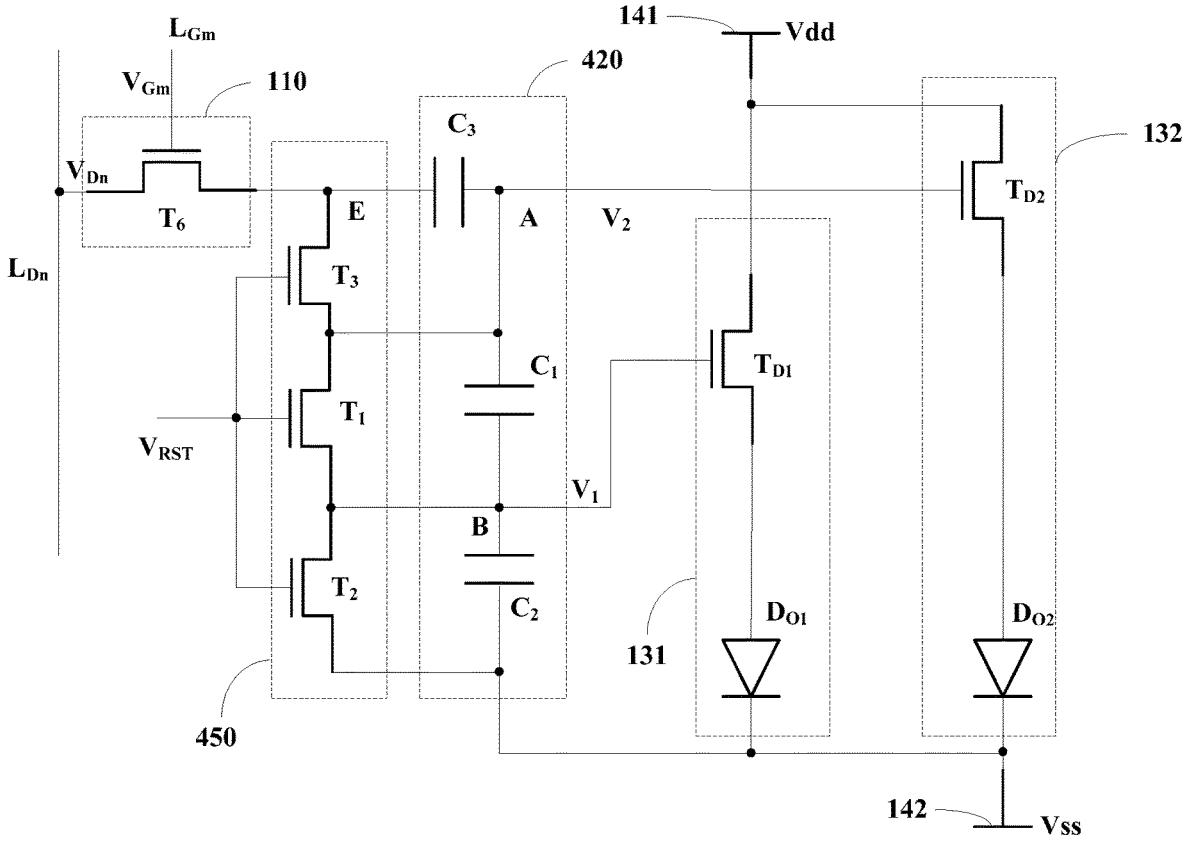
FIG. 4 is a circuit connection diagram schematically showing a pixel circuit according to another embodiment of the present disclosure.

FIG. 4 is a circuit connection diagram schematically showing a pixel circuit according to another embodiment of the present disclosure.

In some embodiments, on the basis of the data storage circuit 120 of the embodiment shown in FIG. 3, the data storage circuit 420 of the embodiment shown in FIG. 4 may comprise a third capacitor $C_3$ in addition to the first capacitor $C_1$ and the second capacitor $C_2$. The third capacitor $C_3$ is disposed between the data switching circuit 110 and the first capacitor $C_1$. For example, a first terminal of the third capacitor $C_3$ is electrically connected to the second terminal of the sixth switching transistor T6, and a second terminal of the third capacitor $C_3$ is electrically connected to the first terminal of the first capacitor $C_1$. The third capacitor serves as a coupler and data voltage divider. With the third capacitor added, the desired values of the first voltage and the second voltage may be output by designing the capacitance of the third capacitor, so that the luminance grayscale accuracy of the pixel circuit may be further improved.

As shown in FIG. 4, the second terminal of the third capacitor $C_3$, the first terminal of the first capacitor $C_1$, and the control terminal of the second driving transistor $T_{D2}$ are electrically connected to the first node A. The second terminal of the first capacitor $C_1$, the first terminal of the second capacitor $C_2$, and the control terminal of the first driving transistor $T_{D1}$ are electrically connected to the second node B. The first terminal of the third capacitor $C_3$ and the second terminal of the sixth switching transistor T6 are electrically connected to a third node E. In a case where the data switching circuit transmits the data voltage signal $V_{Dn}$ received from the data line, the potential of the first node A is $V_A=V_2$, the potential of the second node B is $V_B=V_1$, the potential of the third node E is $V_E=V_{Dn}$, and $$Q_1=Q_2=Q_3, \tag{4}$$

$$Q_1=C_1(V_A-V_B) \tag{5}$$

$$Q_2=C_2(V_B-0) \tag{6}$$

$$Q_3=C_3(V_E-V_A) \tag{7}$$

wherein $Q_1$ is the charge on the first capacitor, $Q_2$ is the charge on the second capacitor, and $Q_3$ is the charge on the third capacitor. Furthermore, in addition to the first capacitor, the second capacitor, and the third capacitor in the circuit, $C_1$, $C_2$, and $C_3$ may represent the capacitance values of the first capacitor, the second capacitor, and the third capacitor in the above formulas, respectively.

From the above formulas (4) to (7), the potential $V_A$ of the first node A, the potential $V_B$ of the second node B, and the potential $V_E$ of the third node E, it can be obtained:

$$V_1 = \frac{V_{Dn}}{1+\frac{C_2}{C_1}+\frac{C_2}{C_3}},$$

$$V_2 = \frac{\left(1+\frac{C_2}{C_1}\right)V_{Dn}}{1+\frac{C_2}{C_1}+\frac{C_2}{C_3}}.$$

Therefore, the first voltage $V_1$ and the second voltage $V_2$ in the embodiment shown in FIG. 4 are obtained by the calculation process described above. The first voltage $V_1$ is output to the first light emitting circuit to control the light emission of the first light emitting device, and the second voltage $V_2$ is output to the second light emitting circuit to control the light emission of the second light emitting device. In some embodiments of the present disclosure, the desired values of the first voltage $V_1$ and the second voltage $V_2$ may be obtained by designing capacitance values of the first capacitor $C_1$, the second capacitor $C_2$, and the third capacitor $C_3$.

It should be noted that the data storage circuit shown in FIG. 4 comprises the third capacitor $C_3$. However, the scope of the embodiments of the present disclosure is not limited thereto. For example, the third capacitor may be replaced with a diode. That is, the diode may be disposed between the data switching circuit and the first capacitor. For example, an anode terminal of the diode is electrically connected to the data switching circuit, and a cathode terminal of the diode is electrically connected to the first terminal of the first capacitor. The diode serves as a coupler and voltage divider.

In some embodiments, on the basis of the initialization circuit 350 of the embodiment shown in FIG. 3, the initialization circuit 450 of the embodiment shown in FIG. 4 may comprise a third switching transistor $T_3$ in addition to the first switching transistor $T_1$ and the second switching transistor $T_2$. A first terminal of the third switching transistor $T_3$ is electrically connected to the data switching circuit. For example, the first terminal of the third switching transistor $T_3$ is electrically connected to the second terminal of the sixth switching transistor T6. In other words, the first terminal of the third switching transistor $T_3$ is electrically connected to the third node E. A second terminal of the third switching transistor $T_3$ is electrically connected to the first terminal of the first capacitor $C_1$. In other words, the second terminal of the third switching transistor $T_3$ is electrically connected to the first node A. A control terminal (for example, a gate) of the third switching transistor $T_3$ may be configured to receive the initialization signal $V_{RST}$.

In some embodiments, the first switching transistor $T_1$, the second switching transistor $T_2$, and the third switching transistor $T_3$ are turned on respectively when they receive the initialization signal $V_{RST}$ respectively, and the voltage of the ground terminal is changed such that the voltage $V_{ss}$ of the ground terminal is raised. This may initiate the voltages of the first node A, the second node B, and the third node E to a fixed voltage, so that a previous frame data signal that may be stored on the first capacitor, the second capacitor, and the third capacitor is removed, which is advantageous for improving the luminance grayscale accuracy of the pixel circuit.

Figure 5:
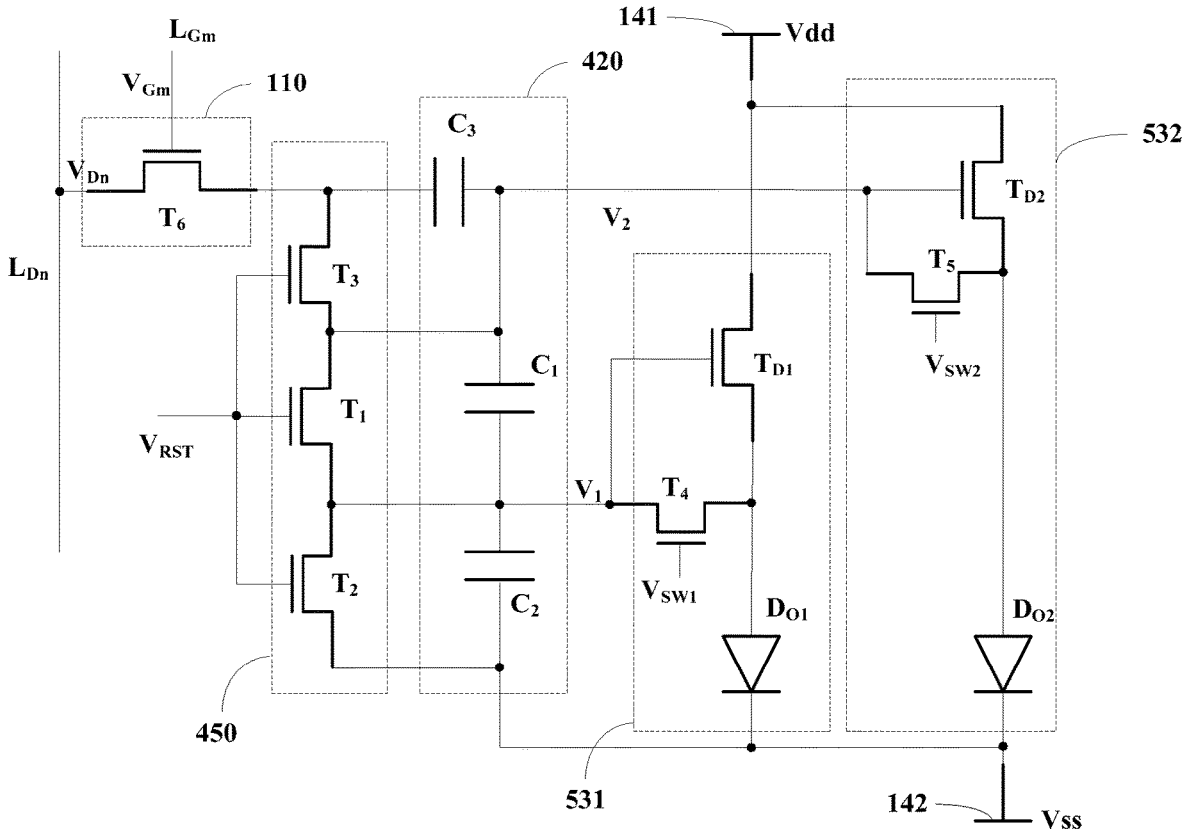
FIG. 5 is a circuit connection diagram schematically showing a pixel circuit according to another embodiment of the present disclosure.

FIG. 5 is a circuit connection diagram schematically showing a pixel circuit according to another embodiment of the present disclosure.

In some embodiments, on the basis of the first light emitting circuit 131 of the embodiment shown in FIG. 4, the first light emitting circuit 531 of the embodiment shown in FIG. 5 may comprise a fourth switching transistor $T_4$, in addition to the first driving transistor $T_{D1}$ and the first light emitting device $D_{O1}$. A first terminal of the fourth switching transistor $T_4$ is electrically connected to the control terminal of the first driving transistor $T_{D1}$. A second terminal of the fourth switching transistor $T_4$ is electrically connected to the second terminal of the first driving transistor $T_{D1}$. A control terminal (for example, a gate) of the fourth switching transistor $T_4$ may be configured to receive a first strobe signal $V_{SW1}$.

The fourth switching transistor $T_4$ may be turned on in response to the first strobe signal $V_{SW1}$, such that the first driving transistor $T_{D1}$ and the fourth switching transistor $T_4$ may form an equivalent diode. In such a case, the power supply voltage $V_{dd}$ may be lowered (e.g., to a low level) to enable the equivalent diode to discharge to the power supply voltage terminal 141. This is because the potential of the first driving transistor is higher than the power supply voltage that is lowered to the low level. This discharge continues until the voltage of the control terminal of the first driving transistor $T_{D1}$ is one threshold voltage $V_{th1}$ ($V_{th1}$ is the threshold voltage of the first driving transistor) higher than the power supply voltage. A driving current $I_{DS1}$ for driving the first light emitting device to emit light is positively correlated to $(V_{GS1}\ V_{th1})^2$ where $V_G$si is a gate-source voltage of the first driving transistor. After the above discharge process, $V_{GS1}=V_1+V_{th1}-$Vdd, the driving current $I_{DS1}$ is positively correlated to $(V_1-V_{dd})^2$. The driving current $I_{DS1}$ will be substantially unaffected by $V_{th1}$. This stage may be referred to as a compensation stage, which may improve the luminance grayscale accuracy of the pixel circuit.

In some embodiments, on the basis of the second light emitting circuit 132 of the embodiment shown in FIG. 4, the second light emitting circuit 532 of the embodiment shown in FIG. 5 may comprise a fifth switching transistor $T_5$, in addition to the second driving transistor $T_{D2}$ and the second light emitting device $D_{O2}$. A first terminal of the fifth switching transistor $T_5$ is electrically connected to the control terminal of the second driving transistor $T_{D2}$. A second terminal of the fifth switching transistor $T_5$ is electrically connected to the second terminal of the second driving transistor $T_{D2}$. A control terminal (for example, a gate) of the fifth switching transistor $T_5$ may be configured to receive a second strobe signal $V_{SW2}$.

The fifth switching transistor $T_5$ may be turned on in response to the second strobe signal $V_{SW2}$, such that the second driving transistor $T_{D2}$ and the fifth switching transistor $T_5$ may form an equivalent diode. In such a case, the power supply voltage $V_{dd}$ may be lowered (e.g., to a low level) to enable the equivalent diode to discharge to the power supply voltage terminal 141. This is because the potential of the second driving transistor is higher than the power supply voltage that is lowered to the low level. This discharge continues until the voltage of the control terminal of the second driving transistor $T_{D2}$ is one threshold voltage $V_{th2}$ ($V_{th2}$ is the threshold voltage of the second driving transistor) higher than the power supply voltage. A driving current $I_{DS2}$ for driving the second light emitting device to emit light is positively correlated to $(V_{GS2}-V_{th2})^2$ where $V_{GS2}$ is a gate-source voltage of the second driving transistor. After the above discharge process, $V_{GS2}=V_2+V_{th2}-Vdd$, the driving current $I_{DS2}$ is positively correlated to $(V_2-V_{dd})^2$. The driving current $I_{DS2}$ will be substantially unaffected by $V_{th2}$. This stage may be referred to as a compensation stage, which may improve the luminance grayscale accuracy of the pixel circuit.

In some embodiments, the first driving transistor $T_{D1}$ and the second driving transistor $T_{D2}$ are configured to discharge to the power supply voltage terminal 141 respectively, in a case where the power supply voltage $V_{dd}$ is lowered (for example, to a low level), the fourth switching transistor $T_4$ receives the first strobe signal $V_{SW1}$, and the fifth switching transistor $T_5$ receives the second strobe signal $V_{SW2}$. This discharge continues until the voltage of the control terminal of the first driving transistor $T_{D1}$ is one threshold voltage $V_{th1}$ higher than the power supply voltage and the voltage of the control terminal of the second driving transistor $T_{D2}$ is one threshold voltage $V_{th2}$ higher than the power supply voltage.

In the embodiment shown in FIG. 5, a pixel circuit structure comprising 8 transistors, 3 capacitors, and 2 light emitting devices is provided. In some embodiments, an area of the first light emitting device is greater than an area of the second light emitting device. Without providing an additional data line, the brightness of the two light emitting devices is different by the voltage division of the three capacitors. The second voltage is higher than the first voltage. At a low grayscale, the second light emitting device emits light. Since the size of the second light emitting device is relatively small, a relatively high brightness of the second light emitting device may also provide a relatively low grayscale from the perspective of the entire pixel. In fact, the brightness of the second light emitting device is relatively high, and a voltage corresponding to the brightness is also relatively high. Therefore, the problem that brightness control is difficult at a low voltage may be solved.

At a high grayscale, the first light emitting device having a relatively large area also emits light. Both of the light emitting devices emit light to reach a desired grayscale. Although the brightness of the second light emitting device is higher than that of the first light emitting device, since the area of the second light emitting device is relatively small, the pixel structure can still obtain the desired grayscale from the perspective of the entire pixel structure.

It should be noted that although all switching transistors (for example, the first switching transistor, the second switching transistor, the third switching transistor, the fourth switching transistor, the fifth switching transistor, and the sixth switching transistor) shown in the figures of embodiments of the present disclosure are NMOS transistors, the scope of embodiments of the present disclosure is not limited thereto. For example, at least one of the first switching transistor, the second switching transistor, the third switching transistor, the fourth switching transistor, the fifth switching transistor, and the sixth switching transistor may be a PMOS transistor. That is, these six switching transistors may be NMOS transistors or PMOS transistors.

It should also be noted that although the pixel circuit shown in FIG. 5 comprises the initialization circuit 450, the fourth switching transistor $T_4$, and the fifth switching transistor $T_5$, the scope of embodiments of the present disclosure is not limited thereto. In some embodiments, the fourth switching transistor $T_4$ and the fifth switching transistor $T_5$ may be provided on the basis of a pixel circuit that does not comprise the initialization circuit. For example, a pixel circuit may comprise the data switching circuit 110, the data storage circuit 420, the first light emitting circuit 531, and the second light emitting circuit 532. For another example, the fourth switching transistor $T_4$ and the fifth switching transistor $T_5$ may be added to the pixel circuit shown in FIG. 2. Such a pixel circuit may comprise the data switching circuit 110, the data storage circuit 120, the first light emitting circuit 531, and the second light emitting circuit 532.

In addition, the fourth switching transistor $T_4$ and the fifth switching transistor $T_5$ may be additionally provided on the basis of a pixel circuit (for example, the pixel circuit shown in FIG. 3) comprising the initialization circuit 350. Such a pixel circuit may comprise the data switching circuit 110, the data storage circuit 120, the initialization circuit 350, the first light emitting circuit 531, and the second light emitting circuit 532.

Figure 6:
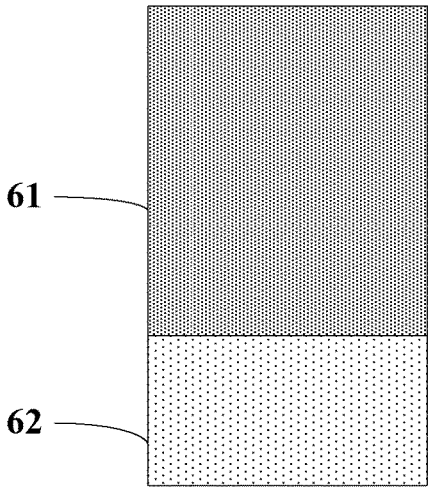
FIG. 6 is a plan view schematically showing a pixel structure according to an embodiment of the present disclosure.

FIG. 6 is a plan view schematically showing a pixel structure according to an embodiment of the present disclosure. As shown in FIG. 6, the pixel structure may comprise a low luminance portion 61 and a high luminance portion 62. The low luminance portion 61 may correspond to the first light emitting circuit, and the high luminance portion 62 may correspond to the second light emitting circuit. For example, an area of the high luminance portion 62 is less than an area of the low luminance portion 61 (corresponding to that the area of the second light emitting device is less than the area of the first light emitting device).

In this embodiment, an entire pixel is divided into two portions. For example, in a manufacturing process, in each pixel, the anode terminal of the light emitting device may be divided into two anode terminals, and a light emitting layer of the light emitting device may be divided into two light emitting layers or may be one light emitting layer. Two output voltages (i.e., the first voltage and the second voltage)

of the pixel circuit are used to drive the two pixel portions to emit light with different brightness respectively. Since the high luminance portion 62 has a relatively small area, even if its brightness is high, the overall brightness is still low from the perspective of the entire pixel. In this way, the pixel portion having a relatively small area may be used to emit a strong light, which is however a weak light for the entire pixel. Since a relatively large driving current is required for the pixel portion having a relatively small area to emit a strong light, the gate-source voltage $V_{GS}$ of the driving transistor is also relatively large, which may weaken the variation rate of $V_{GS}-V_{th}$ (here, the driving current is positively correlated to $(V_{GS}-V_{Th})^2$), thereby improving the luminance grayscale accuracy of the pixel circuit.

Figure 7:
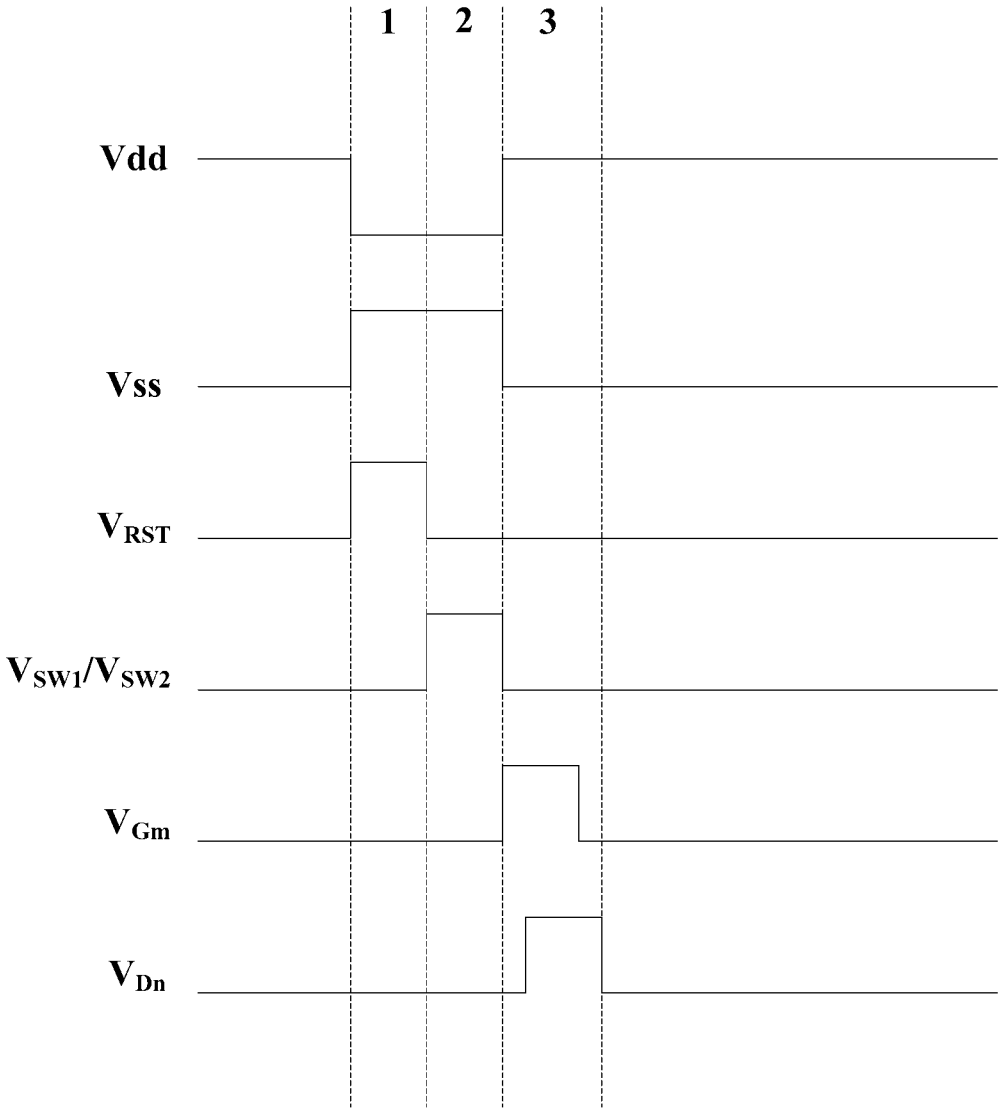
FIG. 7 is a timing control signal diagram of a pixel circuit according to some embodiments of the present disclosure.

FIG. 7 is a timing control signal diagram of a pixel circuit according to some embodiments of the present disclosure. The operation process of the pixel circuit according to some embodiments of the present disclosure will be described in detail below with reference to, for example, the pixel circuit structure shown in FIG. 5 and the timing control signals shown in FIG. 7.

As shown in FIG. 7, in a first stage, an initialization signal $V_{RST}$ with a high level is applied to the initialization circuit 450, and the voltage $V_{ss}$ of the ground terminal 141 is raised to a high level, which may initialize, for example, the voltages of the nodes A and B in FIG. 5 to a fixed voltage. In addition, in this stage, the power supply voltage $V_{dd}$ may be lowered to a low level. This first stage may be referred to as a initialization stage.

Next, in the second stage, the initialization signal $V_{RST}$ is lowered to a low level, the power supply voltage remains the low level, and the voltage of the ground terminal remains the high level. In this stage, a first strobe signal $V_{SW1}$ with a high level is applied to the fourth switching transistor $T_4$, and a second strobe signal $V_{SW2}$ with a high level is applied to the fifth switching transistor $T_5$ such that the first driving transistor $T_{D1}$ and the second driving transistor $T_{D2}$ discharge to the power supply voltage terminal 141 respectively. This discharge continues until the voltage of the control terminal of the first driving transistor $T_{D1}$ and the voltage of the control terminal of the second driving transistor $T_{D2}$ are their respective threshold voltages higher than the power supply voltage. This second stage is the compensation stage.

In still other embodiments, if the power supply voltage $V_{dd}$ is not lowered in the first stage, the power supply voltage $V_{dd}$ may be lowered to the low level in the second stage.

Next, in the third stage, the first strobe signal $V_{SW1}$ and the second strobe signal $V_{SW2}$ are both lowered to a low level, the power supply voltage $V_{dd}$ is raised to a high level, the voltage $V_{ss}$ of the ground terminal is lowered to a low level, the control line $L_{Gm}$ provides an on-signal $V_{Gm}$, and the data line $L_{Dn}$ provides a data voltage signal $V_{Dn}$. Here, the data voltage signal $V_{Dn}$ may be designed to be later than the on-signal $V_{Gm}$ to ensure that the data voltage signal $V_{Dn}$ is transmitted with the data switching circuit 110 fully turned on. The data storage circuit 420 stores the data voltage signal $V_{Dn}$, and outputs a first voltage $V_1$ to the first light emitting circuit and a second voltage $V_2$ to the second light emitting circuit according to the data voltage signal. The first voltage $V_1$ is lower than the second voltage $V_2$. This may control that the first light emitting circuit does not emit light and the second light emitting circuit emits light in a low grayscale situation; and both the first light emitting circuit and the second light emitting circuit emit light in a high grayscale situation. This third stage may be referred to as a light emitting stage. After the third stage, the light emitting process ends and preparations are made for the display of the next frame of data.

Through the above three stages, the light emitting process of the pixel circuit is completed. The pixel circuit and the timing control method of embodiments of the present disclosure may attenuate the problem of a rise in threshold voltage, and may improve the grayscale accuracy at a low grayscale.

In some embodiments, a display device is provided. The display device comprises an array circuit comprising a plurality of pixel circuits as mentioned above.

Figure 8:
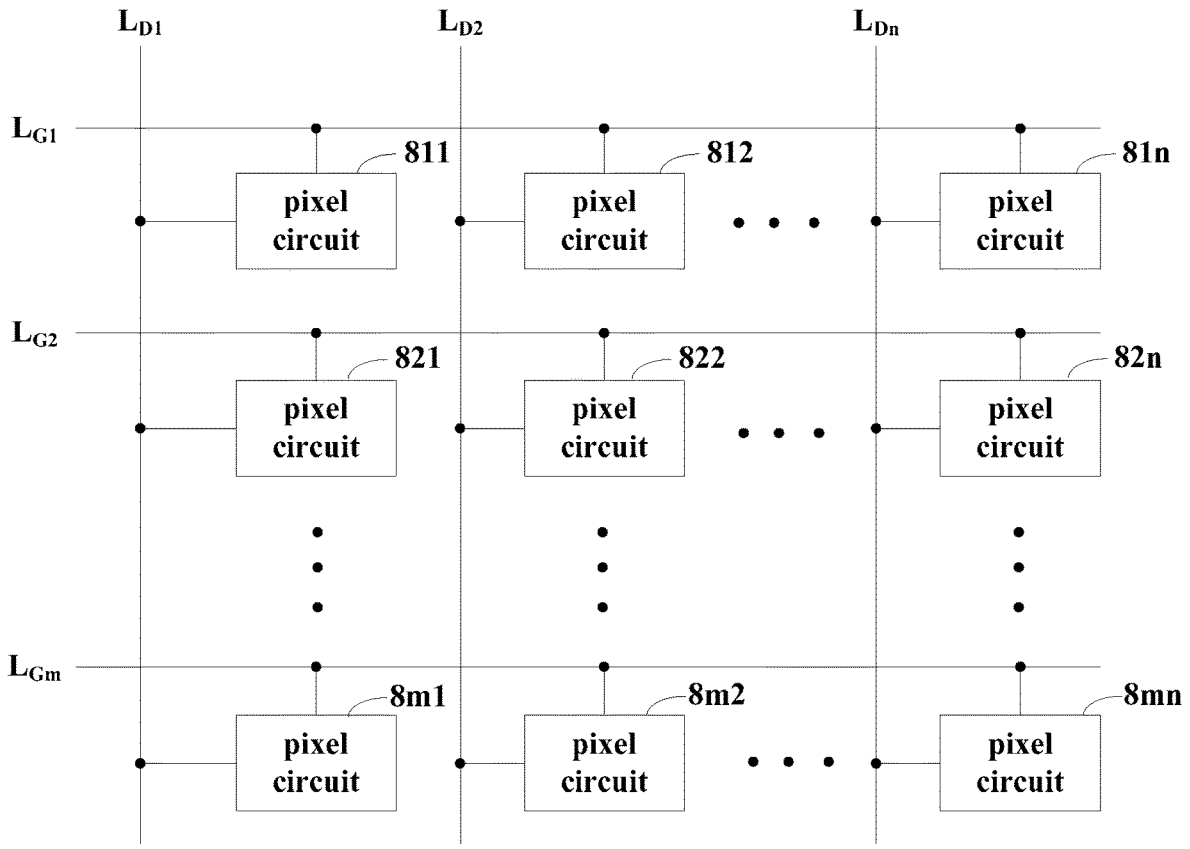
FIG. 8 is a circuit connection diagram schematically showing a display device according to an embodiment of the present disclosure.

FIG. 8 is a circuit connection diagram schematically showing a display device according to an embodiment of the present disclosure.

In some embodiments, the display device may comprise an array circuit, a plurality of data lines, and a plurality of control lines. The array circuit may comprise a plurality of pixel circuits described above (for example, the pixel circuits shown in FIG. 1, FIG. 2, FIG. 3, FIG. 4, or FIG. 5). For example, as shown in FIG. 8, the display device may comprise the array circuit. The array circuit may comprise m×n pixel circuits (for example, pixel circuits 811 to 8 mn, wherein n and m are positive integers). As shown in FIG. 8, the display device may further comprise n data lines (for example, data lines $L_{D1}$ to $L_{Dn}$) and m control lines (for example, control lines $L_{G1}$ to $L_{Gm}$). Each of the plurality of data lines is electrically connected to pixel circuits in a same column of the array circuit. Each of the plurality of control lines is electrically connected to pixel circuits in a same row of the array circuit. Display of image data may be achieved by the display device.

Figure 9:
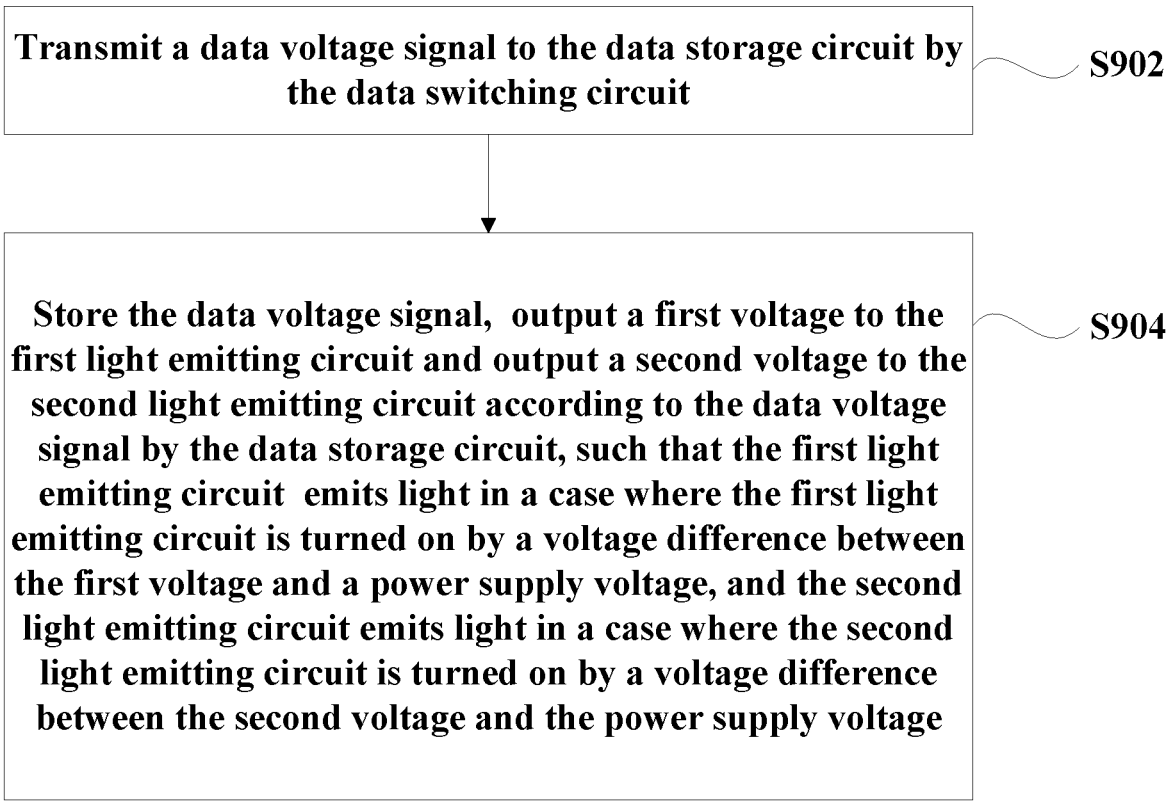
FIG. 9 is a flowchart showing a driving method for a pixel circuit according to an embodiment of the present disclosure.

FIG. 9 is a flowchart showing a driving method for a pixel circuit according to an embodiment of the present disclosure. As described above, the pixel circuit may comprise a data switching circuit, a data storage circuit, a first light emitting circuit, and a second light emitting circuit. The driving method may comprise steps S902 to S904.

In step S902, a data voltage signal is transmitted to the data storage circuit through the data switching circuit.

In step S904, the data voltage signal is stored by the data storage circuit, and a first voltage is output to the first light emitting circuit and a second voltage is output to the second light emitting circuit according to the data voltage signal by the data storage circuit, such that the first light emitting circuit emits light in a case where the first light emitting circuit is turned on by a voltage difference between the first voltage and a power supply voltage, and the second light emitting circuit emits light in a case where the second light emitting circuit is turned on by a voltage difference between the second voltage and the power supply voltage. The first voltage is lower than the second voltage.

According to the driving method of the above embodiment, in a case where a grayscale corresponding to the data voltage signal is a low grayscale, the second light emitting circuit emits light and the first light emitting circuit does not emit light, so that the brightness of the light emitted by the second light emitting circuit may be regarded as the brightness of the entire pixel (each pixel comprises a first light emitting device and a second light emitting device). Since a driving current of the second light emitting circuit may be relatively large, the pixel circuit may improve the luminance grayscale accuracy under the condition of a low grayscale. Here, in this case where the driving current of the second light emitting circuit is relatively large, the brightness of the second light emitting device is relatively strong, but is still weak from the perspective of the entire pixel.

In some embodiments, the pixel circuit may also comprise an initialization circuit that is electrically connected to the ground terminal. Before step S902, the driving method may further comprise: applying an initialization signal to the initialization circuit, raising a voltage of the ground terminal, and lowering the power supply voltage. This achieves initialization of the potentials of the first node A and the second node B in the pixel circuit, which is advantageous for further improving the luminance grayscale accuracy of the pixel circuit.

In some embodiments, the first light emitting circuit may comprise a first driving transistor, a first light emitting device, and a fourth switching transistor; the second light emitting circuit may comprise a second driving transistor, a second light emitting device, and a fifth switching transistor. The specific circuit structures of the first light emitting circuit and the second light emitting circuit have been described in detail above, which will not be described herein. In some embodiments, after the initialization signal is applied to the initialization circuit and before step S902, the driving method may further comprise: in a case where the power supply voltage is lowered, applying a first strobe signal to the fourth switching transistor and applying a second strobe signal to the fifth switching transistor, such that the first driving transistor and the second driving transistor discharge to the power supply voltage terminal respectively. For example, this discharge continues until the voltage of the control terminal of the first driving transistor and the voltage of the control terminal of the second driving transistor are their respective threshold voltages higher than the power supply voltage. Through discharging to the power supply voltage terminal from corresponding driving transistors, the threshold voltages of the corresponding driving transistors may be restored to their normal threshold voltage values, which may further improve the luminance grayscale accuracy of the pixel circuit.

Heretofore, various embodiments of the present disclosure have been described in detail. In order to avoid obscuring the concepts of the present disclosure, some details known in the art are not described. Based on the above description, those skilled in the art can understand how to implement the technical solutions disclosed herein.

Although some specific embodiments of the present disclosure have been described in detail by way of example, those skilled in the art should understand that the above examples are only for the purpose of illustration and are not intended to limit the scope of the present disclosure. It should be understood by those skilled in the art that the above embodiments may be modified or equivalently substituted for part of the technical features without departing from the scope and spirit of the present disclosure. The scope of the disclosure is defined by the following claims.

What is claimed is:

1. A pixel circuit, comprising:

a data switching circuit configured to transmit a data voltage signal received from a data line in response to an on-signal from a control line;

a data storage circuit configured to store the data voltage signal received from the data switching circuit and output a first voltage and a second voltage according to the data voltage signal, wherein the first voltage is lower than the second voltage;

a first light emitting circuit disposed between a power supply voltage terminal and a ground terminal, and configured to emit light in a case where the first light emitting circuit is turned on by a voltage difference between the first voltage and a power supply voltage; and a second light emitting circuit disposed between the power supply voltage terminal and the ground terminal and connected in parallel with the first light emitting circuit, and configured to emit light in a case where the second light emitting circuit is turned on by a voltage difference between the second voltage and the power supply voltage, wherein the data storage circuit comprises a first capacitor and a second capacitor, and wherein a first terminal of the first capacitor is electrically connected to the data switching circuit and the second light emitting circuit, a second terminal of the first capacitor is directly connected to a first terminal of the second capacitor, the first terminal of the second capacitor is directly connected to the first light emitting circuit, and a second terminal of the second capacitor is directly connected to the ground terminal; and the first light emitting circuit and the second light emitting circuit together serve as a light emitting circuit of a pixel structure.

2. The pixel circuit according to claim 1, wherein the first light emitting circuit comprises a first driving transistor and a first light emitting device, wherein a first terminal of the first driving transistor is electrically connected to the power supply voltage terminal, a second terminal of the first driving transistor is electrically connected to a first terminal of the first light emitting device, a control terminal of the first driving transistor is configured to receive the first voltage, and a second terminal of the first light emitting device is electrically connected to the ground terminal;

the second light emitting circuit comprises a second driving transistor and a second light emitting device, wherein a first terminal of the second driving transistor is electrically connected to the power supply voltage terminal, a second terminal of the second driving transistor is electrically connected to a first terminal of the second light emitting device, a control terminal of the second driving transistor is configured to receive the second voltage, and a second terminal of the second light emitting device is electrically connected to the ground terminal.

3. A display device, comprising:

an array circuit comprising a plurality of pixel circuits according to claim 1.

4. The pixel circuit according to claim 2, wherein both of the first driving transistor and the second driving transistor are NMOS transistors;

the first driving transistor is configured to make the first light emitting circuit does not emit light in a case where the data voltage signal is less than a first threshold; and the second driving transistor is configured to make the second light emitting circuit emit light in the case where the data voltage signal is less than the first threshold.

5. The pixel circuit according to claim 4, wherein the first driving transistor is further configured to make the first light emitting circuit emit light in a case where the data voltage signal is greater than or equal to the first threshold; and the second driving transistor is further configured to make the second light emitting circuit emit light in the case where the data voltage signal is greater than or equal to the first threshold.

6. The pixel circuit according to claim 2, wherein both of the first driving transistor and the second driving transistor are PMOS transistors;

the first driving transistor is configured to make the first light emitting circuit does not emit light in a case where the data voltage signal is greater than a second threshold; and the second driving transistor is configured to make the second light emitting circuit emit light in the case where the data voltage signal is greater than the second threshold.

7. The pixel circuit according to claim 6, wherein the first driving transistor is further configured to make the first light emitting circuit emit light in a case where the data voltage signal is less than or equal to the second threshold; and the second driving transistor is further configured to make the second light emitting circuit emit light in the case where the data voltage signal is less than or equal to the second threshold.

8. The pixel circuit according to claim 2, wherein an area of the first light emitting device is greater than an area of the second light emitting device.

9. The pixel circuit according to claim 2, wherein the data storage circuit further comprises:

a third capacitor or a diode disposed between the data switching circuit and the first capacitor.

10. The pixel circuit according to claim 9, further comprising:

an initialization circuit electrically connected to the ground terminal, and configured to raise a voltage of the first terminal of the first capacitor and a voltage of the first terminal of the second capacitor to a fixed voltage to perform an initialization process in response to an initialization signal and in a case where a voltage of the ground terminal is raised.

11. The pixel circuit according to claim 10, wherein the initialization circuit comprises:

a first switching transistor, of which a first terminal is electrically connected to the first terminal of the first capacitor, a second terminal is electrically connected to the second terminal of the first capacitor, and a control terminal is configured to receive the initialization signal; and a second switching transistor, of which a first terminal is electrically connected to the first terminal of the second capacitor, a second terminal is electrically connected to the ground terminal, and a control terminal is configured to receive the initialization signal.

12. The pixel circuit according to claim 11, wherein the initialization circuit further comprises:

a third switching transistor, of which a first terminal is electrically connected to the data switching circuit, a second terminal is electrically connected to the first terminal of the first capacitor, and a control terminal is configured to receive the initialization signal.

13. The pixel circuit according to claim 12, wherein the first light emitting circuit further comprises: a fourth switching transistor, of which a first terminal is electrically connected to the control terminal of the first driving transistor, a second terminal is electrically connected to the second terminal of the first driving transistor, and a control terminal is configured to receive a first strobe signal;

the second light emitting circuit further comprises: a fifth switching transistor, of which a first terminal is electrically connected to the control terminal of the second driving transistor, a second terminal is electrically connected to the second terminal of the second driving transistor, and a control terminal is configured to receive a second strobe signal;

wherein the first driving transistor and the second driving transistor are configured to discharge to the power supply voltage terminal respectively, in a case where the power supply voltage is lowered, the fourth switching transistor receives the first strobe signal, and the fifth switching transistor receives the second strobe signal.

14. The pixel circuit according to claim 13, wherein the data switching circuit comprises:

a sixth switching transistor, of which a first terminal is electrically connected to the data line, a second terminal is electrically connected to the data storage circuit, and a control terminal is connected to the control line.

15. The pixel circuit according to claim 2, wherein the first light emitting circuit further comprises: a fourth switching transistor, of which a first terminal is electrically connected to the control terminal of the first driving transistor, a second terminal is electrically connected to the second terminal of the first driving transistor, and a control terminal is configured to receive a first strobe signal;

the second light emitting circuit further comprises: a fifth switching transistor, of which a first terminal is electrically connected to the control terminal of the second driving transistor, a second terminal is electrically connected to the second terminal of the second driving transistor, and a control terminal is configured to receive a second strobe signal;

wherein the first driving transistor and the second driving transistor are configured to discharge to the power supply voltage terminal respectively, in a case where the power supply voltage is lowered, the fourth switching transistor receives the first strobe signal, and the fifth switching transistor receives the second strobe signal.

16. A driving method for a pixel circuit, the pixel circuit comprising a data switching circuit, a data storage circuit, a first light emitting circuit, and a second light emitting circuit, wherein the data storage circuit comprises a first capacitor and a second capacitor, and wherein a first terminal of the first capacitor is electrically connected to the data switching circuit and the second light emitting circuit, a second terminal of the first capacitor is directly connected to a first terminal of the second capacitor, the first terminal of the second capacitor is directly connected to the first light emitting circuit, and a second terminal of the second capacitor is directly connected to the ground terminal; and the first light emitting circuit and the second light emitting circuit together serve as a light emitting circuit of a pixel structure;

the driving method comprising:

transmitting a data voltage signal to the data storage circuit by the data switching circuit; and storing the data voltage signal, outputting a first voltage to the first light emitting circuit and outputting a second voltage to the second light emitting circuit according to the data voltage signal by the data storage circuit, such that the first light emitting circuit emits light in a case where the first light emitting circuit is turned on by a voltage difference between the first voltage and a power supply voltage, and the second light emitting circuit emits light in a case where the second light emitting circuit is turned on by a voltage difference between the second voltage and the power supply voltage, wherein the first voltage is lower than the second voltage.

17. The driving method according to claim 16, wherein the pixel circuit further comprises an initialization circuit electrically connected to a ground terminal; and before the data voltage signal is transmitted to the data storage circuit, the driving method further comprises: applying an initialization signal to the initialization circuit, raising a voltage of the ground terminal, and lowering the power supply voltage.

18. The driving method according to claim 17, wherein the first light emitting circuit comprises a first driving transistor, a first light emitting device, and a fourth switching transistor, a first terminal of the first driving transistor being electrically connected to a power supply voltage terminal, a second terminal of the first driving transistor being electrically connected to a first terminal of the first light emitting device, a control terminal of the first driving transistor being configured to receive the first voltage, a second terminal of the first light emitting device being electrically connected to the ground terminal, a first terminal of the fourth switching transistor being electrically connected to the control terminal of the first driving transistor, a second terminal of the fourth switching transistor being electrically connected to the second terminal of the first driving transistor, and a control terminal of the fourth switching transistor being configured to receive a first strobe signal;

the second light emitting circuit comprises a second driving transistor, a second light emitting device, and a fifth switching transistor, a first terminal of the second driving transistor being electrically connected to the power supply voltage terminal, a second terminal of the second driving transistor being electrically connected to a first terminal of the second light emitting device, a control terminal of the second driving transistor being configured to receive the second voltage, a second terminal of the second light emitting device being electrically connected to the ground terminal, a first terminal of the fifth switching transistor being electrically connected to the control terminal of the second driving transistor, a second terminal of the fifth switching transistor being electrically connected to the second terminal of the second driving transistor, and a control terminal of the fifth switching transistor being configured to receive a second strobe signal; and after the initialization signal is applied to the initialization circuit and before the data voltage signal is transmitted to the data storage circuit, the driving method further comprises: in a case where the power supply voltage is lowered, applying the first strobe signal to the fourth switching transistor and applying the second strobe signal to the fifth switching transistor such that the first driving transistor and the second driving transistor discharge to the power supply voltage terminal respectively.

* * * * *